US011445824B2

(12) United States Patent
Chen et al.

(10) Patent No.: US 11,445,824 B2
(45) Date of Patent: Sep. 20, 2022

(54) SLIDE RAIL ASSEMBLY AND SLIDE RAIL KIT THEREOF

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Shun-Ho Yang, Kaohsiung (TW); Kai-Wen Yu, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 17/116,377

(22) Filed: Dec. 9, 2020

(65) Prior Publication Data

US 2022/0061528 A1 Mar. 3, 2022

(30) Foreign Application Priority Data

Sep. 1, 2020 (TW) ..... 109130318

(51) Int. Cl.
*A47B 88/443* (2017.01)
*A47B 88/49* (2017.01)

(52) U.S. Cl.
CPC ..... *A47B 88/443* (2017.01); *A47B 88/49* (2017.01); *A47B 2210/0016* (2013.01)

(58) Field of Classification Search
CPC ..... A47B 88/49; A47B 88/443; A47B 2210/0016
USPC ..... 312/333, 334.47
See application file for complete search history.

(56) References Cited

U.S. PATENT DOCUMENTS 6,935,710 B2 * 8/2005 Chen ..... A47B 88/487 312/334.44
8,007,060 B2 * 8/2011 Duan ..... H05K 7/1489 312/334.44
9,670,956 B2 6/2017 Judge
9,980,566 B2 * 5/2018 Chen ..... F16C 43/04
(Continued)

FOREIGN PATENT DOCUMENTS

EP 3307037 A1 4/2018
JP 3138146 U 11/2007
TW 201036574 A 10/2010

OTHER PUBLICATIONS

European Patent Office Official Action dated Aug. 25, 2021 for corresponding EP Application No. 20 21 4545.

*Primary Examiner* — James O Hansen
(74) *Attorney, Agent, or Firm* — Rosenberg, Klein & Lee

(57) ABSTRACT

A slide rail assembly has a slide rail kit that includes a slide rail, a component, and an operation member. The slide rail includes a longitudinal wall. The component is movably disposed on the slide rail. The operation member can be used to operate the component and includes a driving portion with a first section and a second section connected to the first section. The first section and the second section have a first transverse height and a second transverse height with respect to the longitudinal wall of the slide rail respectively. The second transverse height is greater than the first transverse height. The first section and the longitudinal wall support each other to keep the second section at the second transverse height.

15 Claims, 12 Drawing Sheets

(56) References Cited

U.S. PATENT DOCUMENTS

2018/0202490 A1* 7/2018 Chen ..... F16C 29/10
2018/0317652 A1* 11/2018 Chen ..... A47B 88/49

* cited by examiner

SLIDE RAIL ASSEMBLY AND SLIDE RAIL KIT THEREOF

FIELD OF THE INVENTION

The present invention relates to a slide rail and more particularly to a slide rail assembly that is reliable.

BACKGROUND OF THE INVENTION

Referring to FIG. 1 and FIG. 2, a conventional slide rail 100 has a longitudinal length. The slide rail 100 is provided thereon with a first blocking member 102, a second blocking member 104, a first operation member 106, and a second operation member 108. The first blocking member 102 and the second blocking member 104 are pivotally connected to the slide rail 100 via a first shaft A1 and a second shaft A2 respectively so that when the slide rail 100 is at a predetermined position (e.g., an extended position) with respect to another slide rail 101 (see FIG. 2), the second blocking member 104 and the first blocking member 102 are respectively blocked by the front end and the rear end of a blocking portion B of the slide rail 101 to prevent the slide rail 100 from being displaced from the predetermined position in an opening direction as well as in a retracting direction.

The first operation member 106 and the second operation member 108 can be used to drive the first blocking member 102 and the second blocking member 104 respectively so that the two blocking members are no longer blocked by the blocking portion B of the slide rail 101. The structural configurations that enable the first operation member 106 to drive the first blocking member 102 are substantially the same as those enabling the second operation member 108 to drive the second blocking member 104. As shown in FIG. 2, the first operation member 106 includes a driving portion 110 that has a uniform, or single, height T. Therefore, should one of the driving portion 110 of the first operation member 106 and a corresponding portion 112 of the first blocking member 102 be deformed or shifted in place with respect to the other due to an external force or unexpected factor, producing an excessively large or unexpected difference in position between them in the transverse direction (e.g., the driving portion 110 of the first operation member 106 is deformed or shifted in place, or the first blocking member 102 is shifted in a predetermined transverse direction K), the depth of contact (e.g., the transverse depth of contact) between the driving portion 110 of the first operation member 106 and the corresponding portion 112 of the first blocking member 102 upon their engagement may be reduced, thus hindering the first operation member 106 from driving the first blocking member 102, or the driving portion 110 of the first operation member 106 and the corresponding portion 112 of the first blocking member 102 may be transversely offset from each other to such an extent that the first operation member 106 cannot drive the first blocking member 102 at all, resulting in a driving failure.

As user needs vary, it is worthwhile to develop a different slide rail product that features reliability.

SUMMARY OF THE INVENTION

The present invention relates to a reliable slide rail assembly and a slide rail kit thereof.

According to one aspect of the present invention, a slide rail assembly includes a first rail, a second rail, a first component, and a first operation member. The second rail can be longitudinally displaced with respect to the first rail and includes a first wall, a second wall, and a longitudinal wall connected between the first wall and the second wall of the second rail. The first component is movably provided at the second rail. The first operation member is movably provided at the second rail and is configured to be operated in order to drive the first component. The first operation member includes a first driving portion, and the first driving portion has a first section and a second section connected to the first section. The first section of the first driving portion has a first transverse height with respect to the longitudinal wall of the second rail, and the second section has a second transverse height with respect to the longitudinal wall of the second rail, wherein the second transverse height is greater than the first transverse height. The first section of the first driving portion and the longitudinal wall of the second rail support each other to keep the second section of the first driving portion at the second transverse height. When the first operation member is operated, the second section of the first driving portion is brought into contact with a first corresponding portion of the first component in order for the first operation member to drive the first component.

Preferably, the slide rail assembly further includes a second component and a second operation member, both movably provided at the second rail. The second operation member is configured to be operated in order to drive the second component. The second operation member includes a second driving portion, and the second driving portion has a first predetermined section and a second predetermined section connected to the first predetermined section. The first predetermined section of the second driving portion has another first transverse height with respect to the longitudinal wall of the second rail, and the second predetermined section has another second transverse height with respect to the longitudinal wall of the second rail, wherein the another second transverse height is greater than the another first transverse height. The first predetermined section of the second driving portion and the longitudinal wall of the second rail support each other to keep the second predetermined section of the second driving portion at the another second transverse height. When the second operation member is operated, the second predetermined section of the second driving portion is brought into contact with a second corresponding portion of the second component in order for the second operation member to drive the second component.

Preferably, the first rail includes a blocking portion, and both the first component and the second component can be in one of a first state and a second state. When the second rail is at an extended position with respect to the first rail and both the first component and the second component are in the first state, the first component and the second component are respectively adjacent to two ends of the blocking portion to prevent the second rail from moving away from the extended position.

Preferably, the slide rail assembly further includes an elastic member provided at the second rail. The elastic member is configured to apply an elastic force to the first component and the second component and thereby keep the first component and the second component in the first state.

Preferably, the first component is configured to be moved and thereby brought from the first state into the second state when the first operation member is operated, thus allowing the second rail to be displaced from the extended position in a first direction.

Preferably, the second component is configured to be moved and thereby brought from the first state into the second state when the second operation member is operated, thus allowing the second rail to be displaced from the extended position in a second direction, which is the opposite direction of the first direction.

Preferably, the blocking portion is adjacent to a front end of the first rail.

Preferably, the slide rail assembly further includes a third rail, and the first rail is movably mounted between the third rail and the second rail.

Preferably, the first component is pivotally connected to the second rail via a first shaft, and the second component via a second shaft.

According to another aspect of the present invention, a slide rail assembly includes a first rail, a second rail, a first component, and a first operation member. The second rail can be longitudinally displaced with respect to the first rail and includes a first wall, a second wall, and a longitudinal wall connected between the first wall and the second wall of the second rail. The first component is movably provided at the second rail. The first operation member is configured to be operated in order to drive the first component. The first operation member includes a first driving portion, and the first driving portion has a first section and a second section connected to the first section. The first section of the first driving portion has a first transverse height with respect to the longitudinal wall of the second rail, and the second section has a second transverse height with respect to the longitudinal wall of the second rail, wherein the second transverse height is greater than the first transverse height. When the first operation member is operated, a first guiding feature of the second section of the first driving portion is brought into contact with a first corresponding portion of the first component in order for the first operation member to drive the first component.

Preferably, the slide rail assembly further includes a second component and a second operation member, both movably provided at the second rail. The second operation member is configured to be operated in order to drive the second component. The second operation member includes a second driving portion, and the second driving portion has a first predetermined section and a second predetermined section connected to the first predetermined section. The first predetermined section of the second driving portion has another first transverse height with respect to the longitudinal wall of the second rail, and the second predetermined section has another second transverse height with respect to the longitudinal wall of the second rail, wherein the another second transverse height is greater than the another first transverse height. When the second operation member is operated, a second guiding feature of the second predetermined section of the second driving portion is brought into contact with a second corresponding portion of the second component in order for the second operation member to drive the second component.

Preferably, the first rail includes a blocking portion, and both the first component and the second component can be in one of a first state and a second state. When the second rail is at an extended position with respect to the first rail and both the first component and the second component are in the first state, the first component and the second component are respectively adjacent to two ends of the blocking portion to prevent the second rail from moving away from the extended position.

Preferably, the slide rail assembly further includes an elastic member provided at the second rail. The elastic member is configured to apply an elastic force to the first component and the second component and thereby keep the first component and the second component in the first state.

Preferably, the first component is configured to be moved and thereby brought from the first state into the second state when the first operation member is operated, thus allowing the second rail to be displaced from the extended position in a first direction.

Preferably, the second component is configured to be moved and thereby brought from the first state into the second state when the second operation member is operated, thus allowing the second rail to be displaced from the extended position in a second direction, which is the opposite direction of the first direction.

Preferably, the blocking portion is adjacent to a front end of the first rail.

Preferably, the slide rail assembly further includes a third rail, and the first rail is movably mounted between the third rail and the second rail.

Preferably, the first component is pivotally connected to the second rail via a first shaft, and the second component via a second shaft.

According to still another aspect of the present invention, a slide rail kit includes a slide rail, a first component, a second component, a first operation member, and a second operation member. The slide rail includes a first wall, a second wall, and a longitudinal wall connected between the first wall and the second wall of the slide rail. The first component and the second component are movably provided at the slide rail. The first operation member and the second operation member are configured to be operated in order to drive the first component and the second component respectively. The first operation member includes a first driving portion, and the first driving portion has a first section and a second section connected to the first section. The first section of the first driving portion has a first transverse height with respect to the longitudinal wall of the slide rail, and the second section has a second transverse height with respect to the longitudinal wall of the slide rail, wherein the second transverse height is greater than the first transverse height. The first section of the first driving portion and the longitudinal wall of the slide rail support each other to keep the second section of the first driving portion at the second transverse height. The second operation member includes a second driving portion, and the second driving portion has a first predetermined section and a second predetermined section connected to the first predetermined section. The first predetermined section of the second driving portion has another first transverse height with respect to the longitudinal wall of the slide rail, and the second predetermined section has another second transverse height with respect to the longitudinal wall of the slide rail, wherein the another second transverse height is greater than the another first transverse height. The first predetermined section of the second driving portion and the longitudinal wall of the slide rail support each other to keep the second predetermined section of the second driving portion at the another second transverse height.

Preferably, when the first operation member is operated, a first guiding feature of the second section of the first driving portion is brought into contact with a first corresponding portion of the first component in order for the first operation member to drive the first component, and when the second operation member is operated, a second guiding feature of the second predetermined section of the second driving portion is brought into contact with a second corresponding portion of the second component in order for the second operation member to drive the second component.

DETAILED DESCRIPTION OF THE INVENTION

Figure 1:
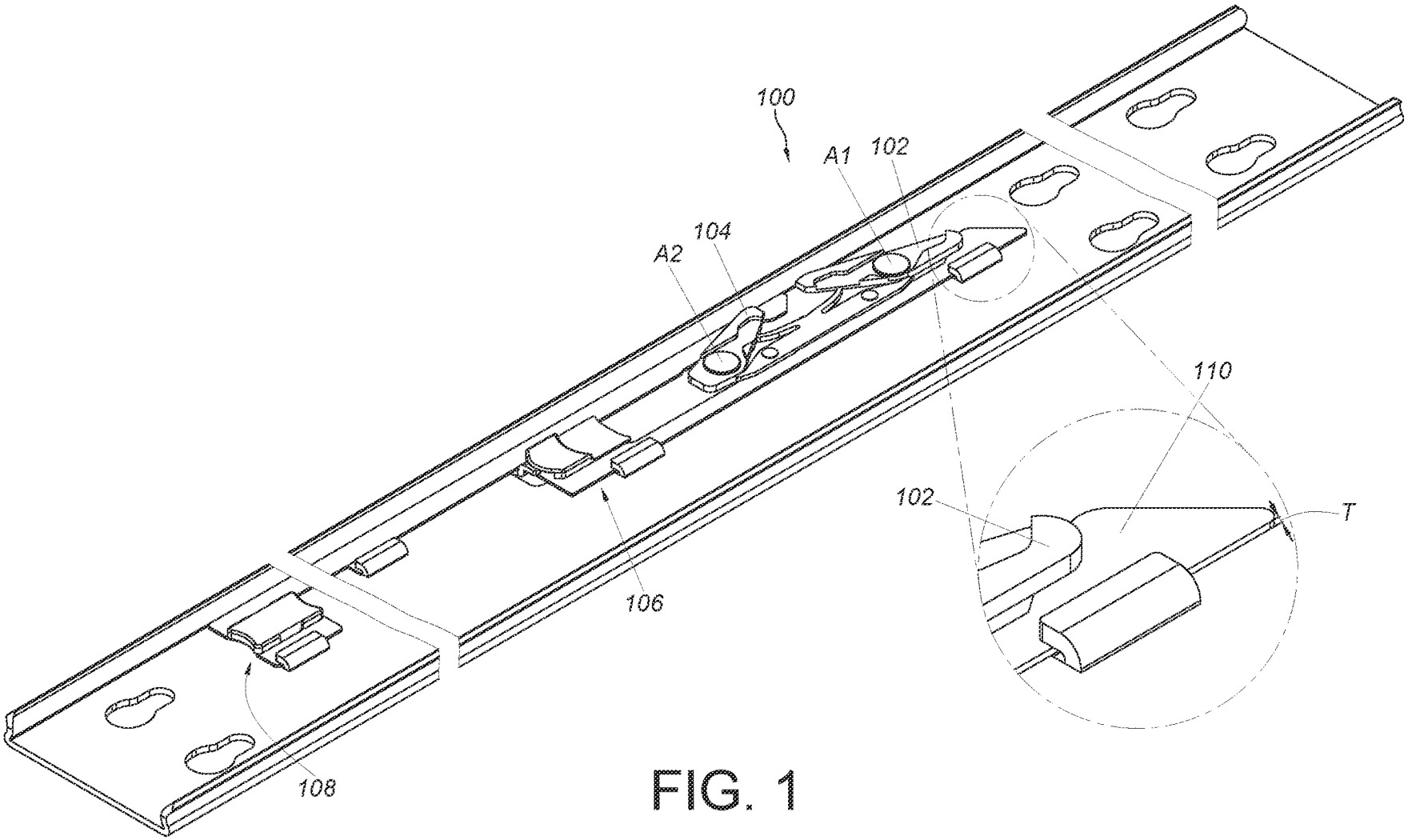
FIG. 1 PRIOR ART
FIG. 1 is a perspective view of a conventional slide rail.
Figure 2:
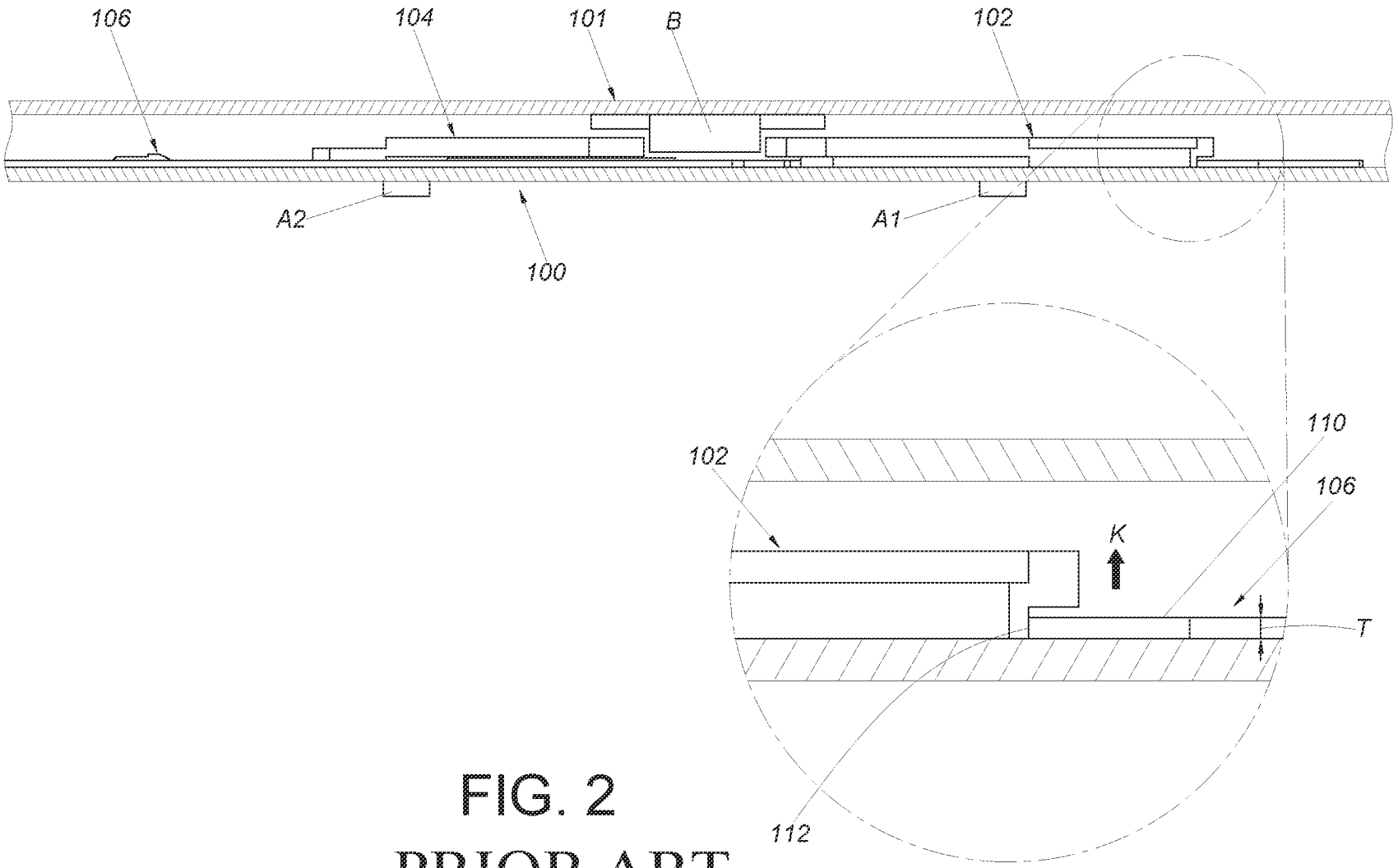
FIG. 2 PRIOR ART
FIG. 2 is a schematic view showing a conventional slide rail assembly.
Figure 3:
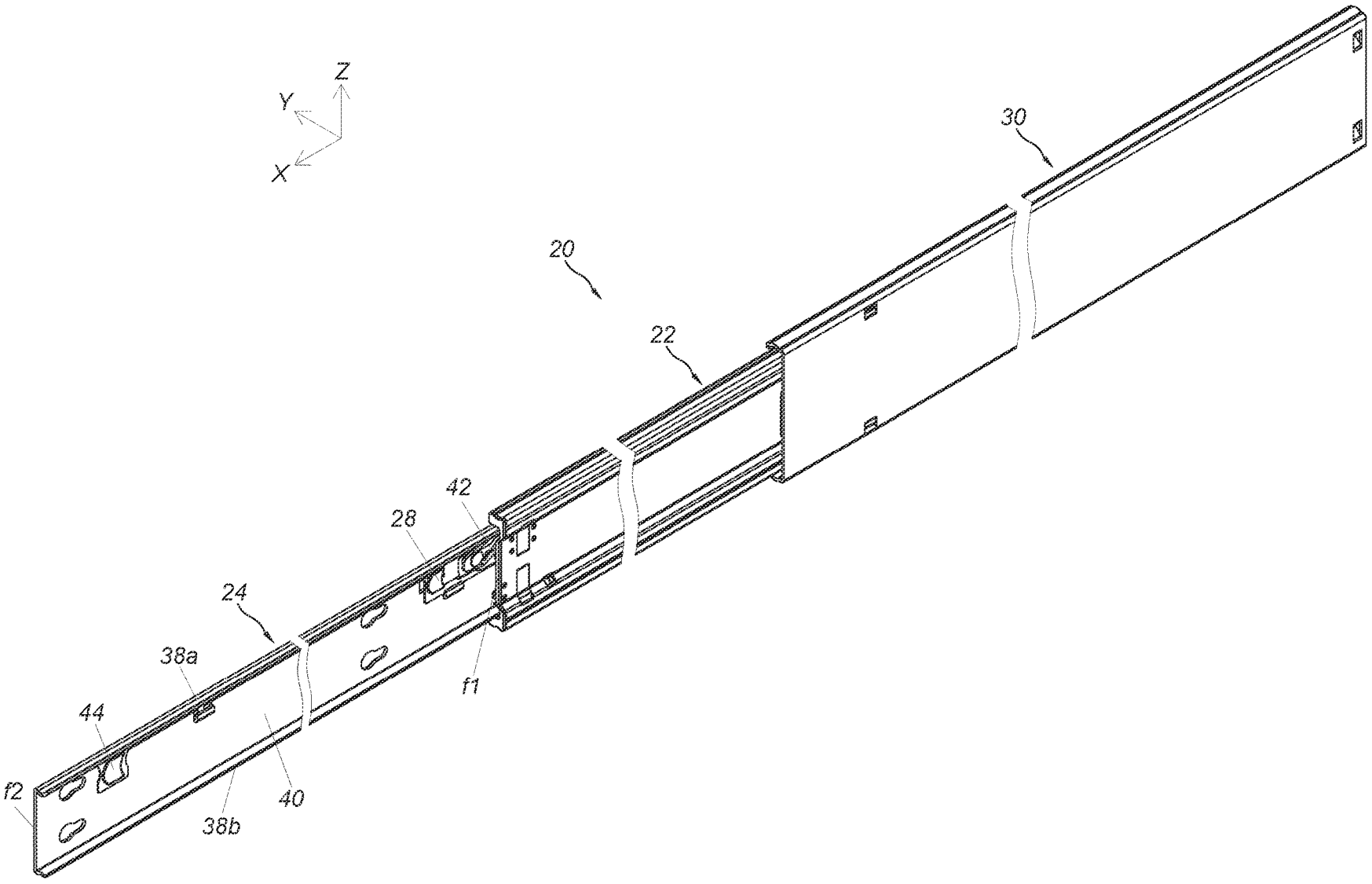
FIG. 3 is an assembled perspective view of the slide rail assembly according to an embodiment of the present invention, wherein the slide rail assembly includes a first rail, a second rail, and a third rail.
Figure 4:
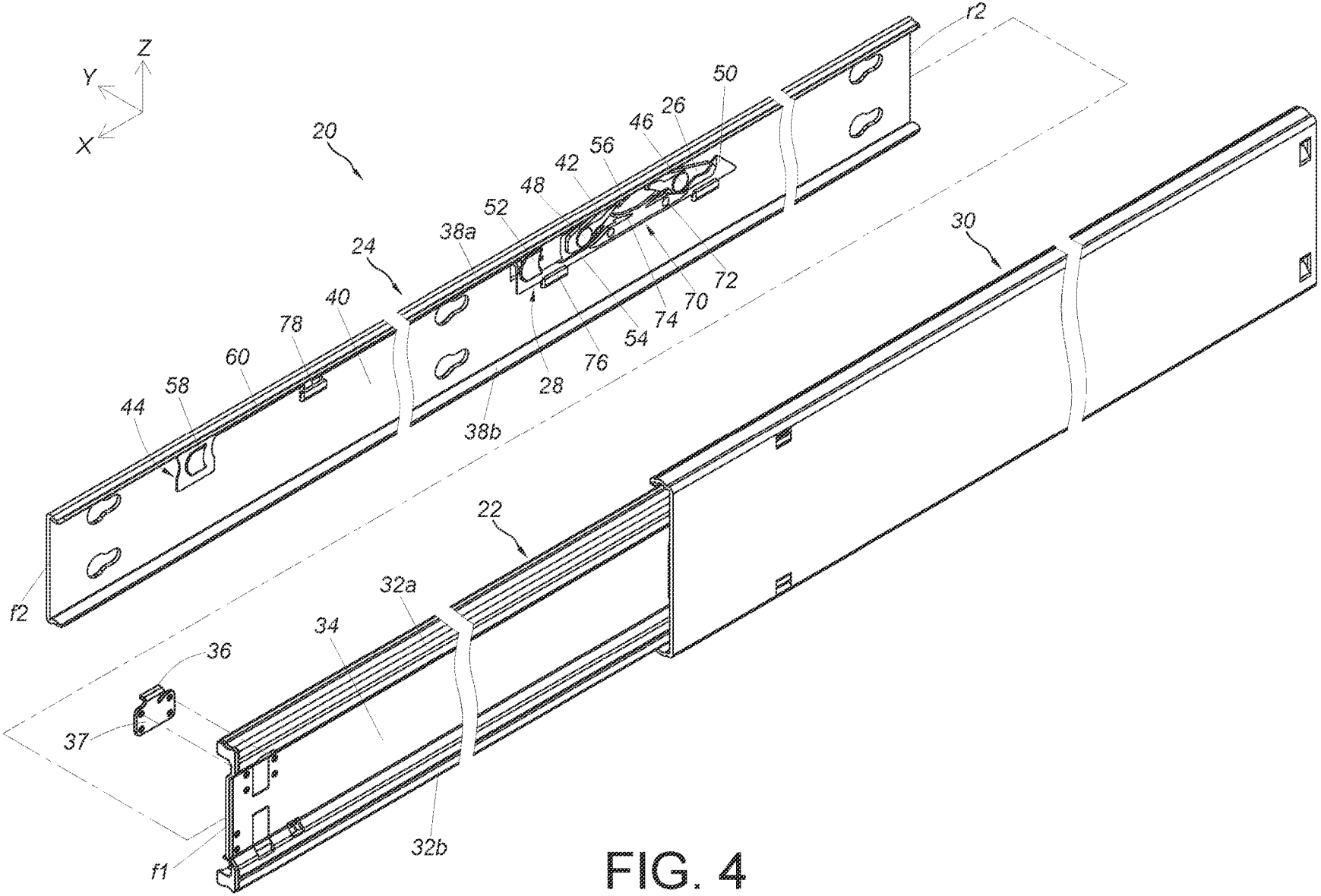
FIG. 4 is an exploded perspective view of the slide rail assembly according to the embodiment of the present invention.

Referring to FIG. 3 and FIG. 4, the slide rail assembly 20 according to an embodiment of the present invention includes a first rail 22, a second rail 24, a first component 26, and a first operation member 28. Preferably, the slide rail assembly 20 further includes a third rail 30, and the first rail 22 is movably mounted between the third rail 30 and the second rail 24 such that the third rail 30 (e.g., an outer rail), the first rail 22 (e.g., an intermediate rail), and the second rail 24 (e.g., an inner rail) jointly constitute a three-section slide rail assembly 20. The first rail 22, the second rail 24, and the third rail 30 can be longitudinally displaced with respect to one another. It is worth mentioning that in this embodiment the X-axis direction is defined as the longitudinal direction (or the length direction or displacement direction of the slide rails), the Y-axis direction as the transverse direction (or the lateral direction of the slide rails), and the Z-axis direction as the vertical direction (or the height direction of the slide rails).

The first rail 22 includes a first wall 32*a*, a second wall 32*b*, and a longitudinal wall 34 connected between the first wall 32*a* and the second wall 32*b* of the first rail 22. The first wall 32*a*, the second wall 32*b*, and the longitudinal wall 34 of the first rail 22 jointly define a channel for receiving the second rail 24.

Preferably, the first rail 22 is provided with a blocking portion 36 adjacent to a front end f1 of the first rail 22. The blocking portion 36 may be connected to the longitudinal wall 34 of the first rail 22 via a connecting portion 37 or may in an alternative embodiment be formed directly on the longitudinal wall 34 of the first rail 22; the present invention has no limitation in this regard.

Preferably, the blocking portion 36 is a projection that protrudes transversely with respect to the longitudinal wall 34 of the first rail 22.

The second rail 24 can be longitudinally displaced with respect to the first rail 22. The second rail 24 includes a first wall 38*a*, a second wall 38*b*, and a longitudinal wall 40 connected between the first wall 38*a* and the second wall 38*b* of the second rail 24. Moreover, the second rail 24 has a front end f2 and a rear end r2.

The first component 26 and the first operation member 28 are movably provided at the second rail 24. Preferably, the slide rail assembly 20 further includes a second component 42 and a second operation member 44, both movably provided at the second rail 24 too. The first component 26, the first operation member 28, the second component 42, and the second operation member 44 constitute a slide rail kit.

Figure 5:
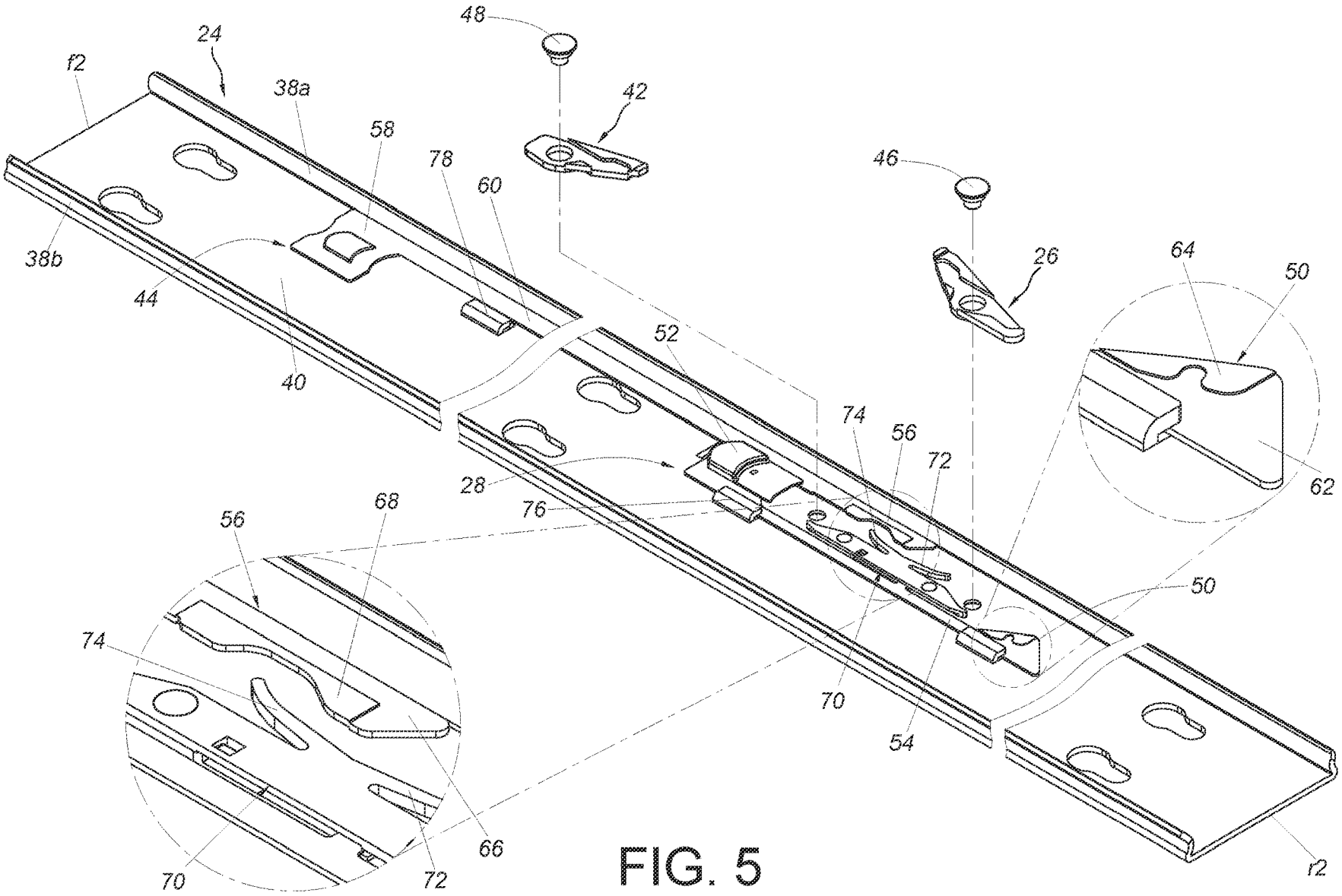
FIG. 5 is an exploded perspective view of the second rail and the two components on the second rail of the slide rail assembly according to the embodiment of the present invention.

As shown in FIG. 4 and FIG. 5, the first component 26 and the second component 42 are pivotally connected to the longitudinal wall 40 of the second rail 24 via a first shaft 46 and a second shaft 48 respectively. The first operation member 28 is configured to be operated in order to drive the first component 26, and the first operation member 28 includes a first driving portion 50. Preferably, the first operation member 28 further includes a first operating portion 52 and a longitudinal extension portion 54 connected between the first driving portion 50 and the first operating portion 52, and the first driving portion 50 is adjacent to the first component 26 and is configured to drive the first component 26. Similarly, the second operation member 44 is configured to be operated in order to drive the second component 42, and the second operation member 44 includes a second driving portion 56. Preferably, the second operation member 44 further includes a second operating portion 58 and a longitudinal extension portion 60 connected between the second driving portion 56 and the second operating portion 58, and the second driving portion 56 is adjacent to the second component 42 and is configured to drive the second component 42. In addition, the first driving portion 50 has a first section 62 and a second section 64 connected to the first section 62 (see FIG. 5) Similarly, the second driving portion 56 has a first predetermined section 66 and a second predetermined section 68 connected to the first predetermined section 66 (see FIG. 5).

Preferably, the slide rail assembly 20 further includes an elastic member 70 provided at the second rail 24, and the elastic member 70 is configured to apply an elastic force to the first component 26 and the second component 42. For example, the elastic member 70 has a first elastic portion 72 for applying an elastic force to the first component 26 and a second elastic portion 74 for applying an elastic force to the second component 42.

Preferably, the second rail 24 is further provided with at least one first retaining portion 76 for supporting the first operation member 28 and at least one second retaining portion 78 for supporting the second operation member 44.

Figure 6:
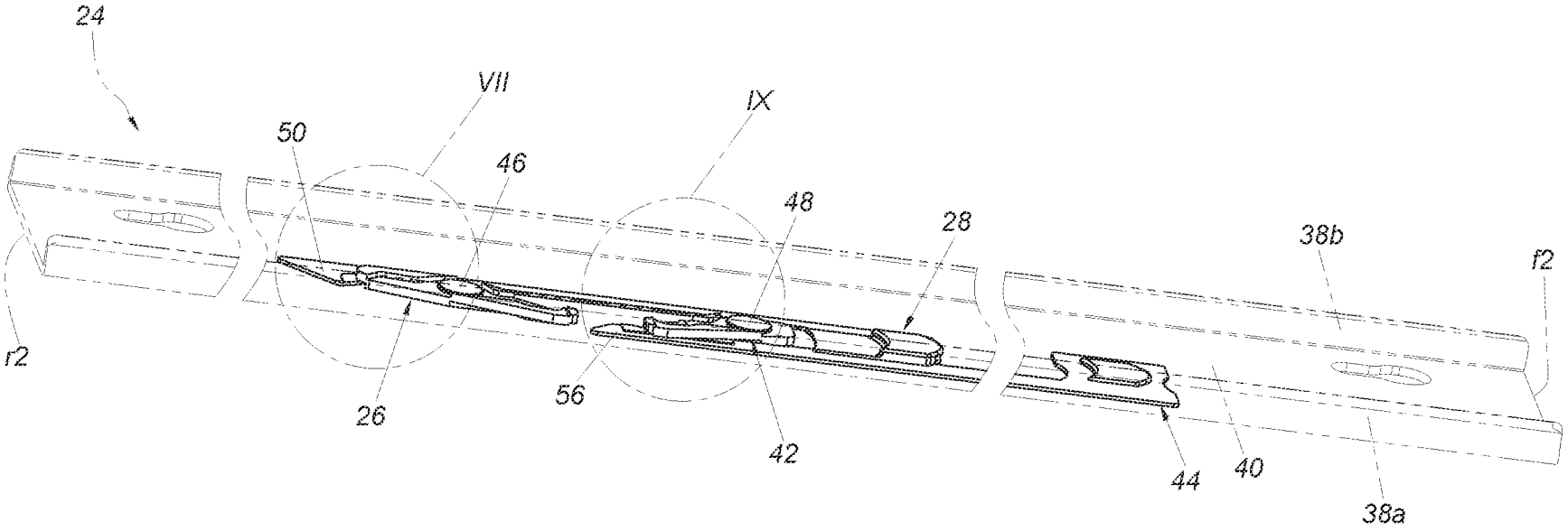
FIG. 6 is a schematic view of the second rail of the slide rail assembly according to the embodiment of the present invention.
Figure 7:
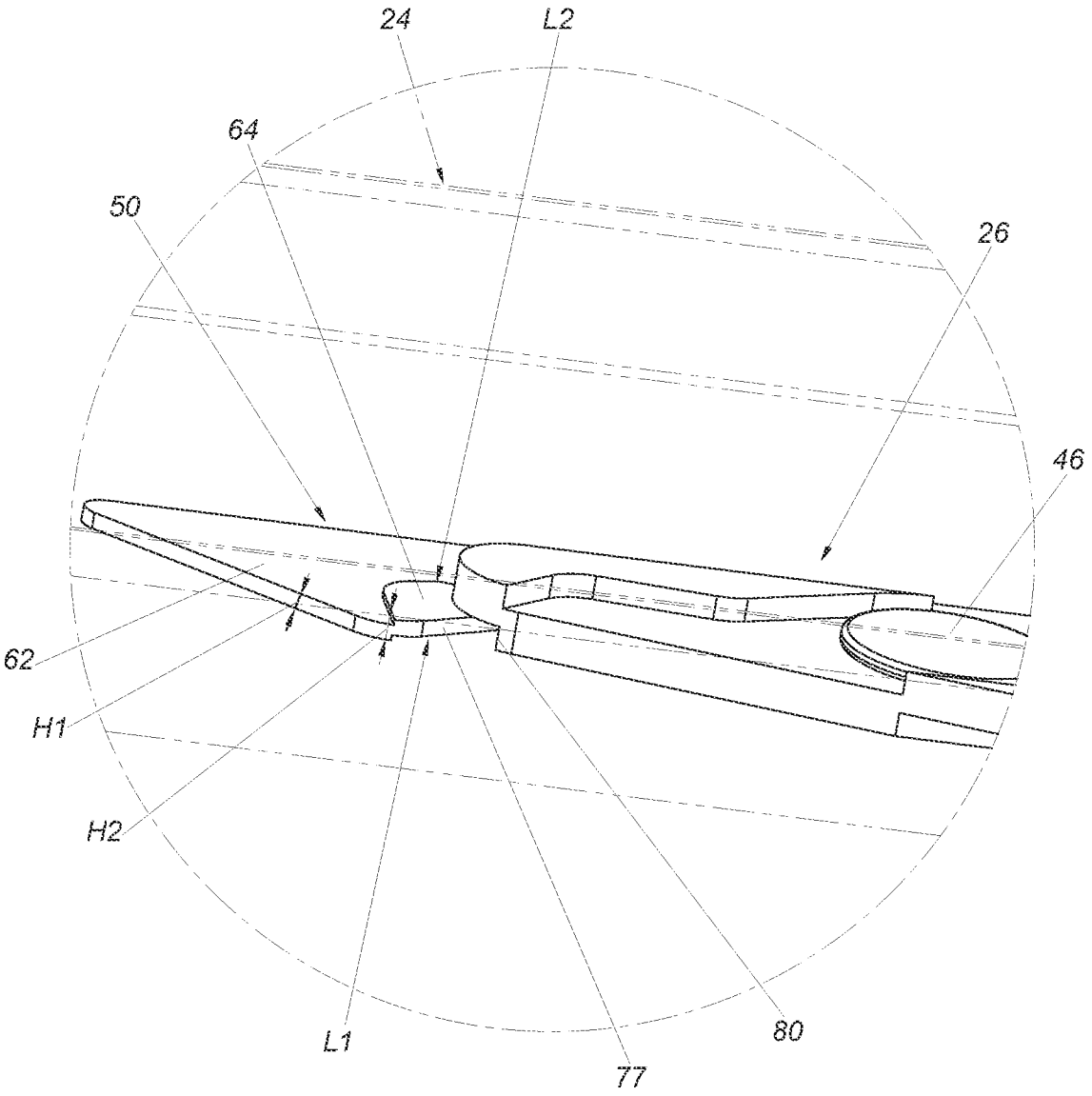
FIG. 7 is an enlarged view of the circled area VII in FIG. 6.
Figure 8:
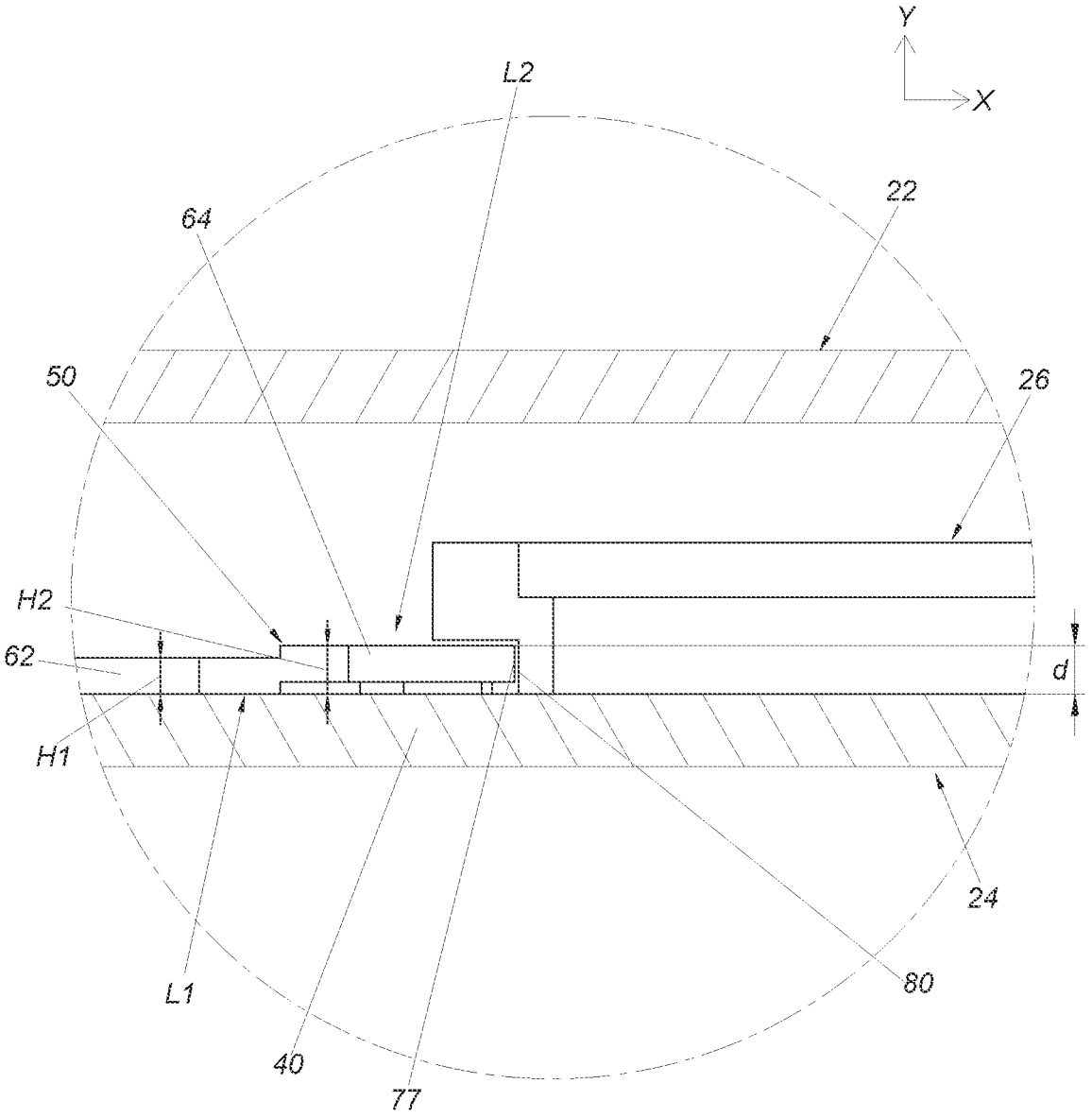
FIG. 8 is a schematic view showing the structures between the first rail and the second rail of the slide rail assembly according to the embodiment of the present invention, in particular one of the two components and a driving portion of the corresponding operation member.
Figure 8A:
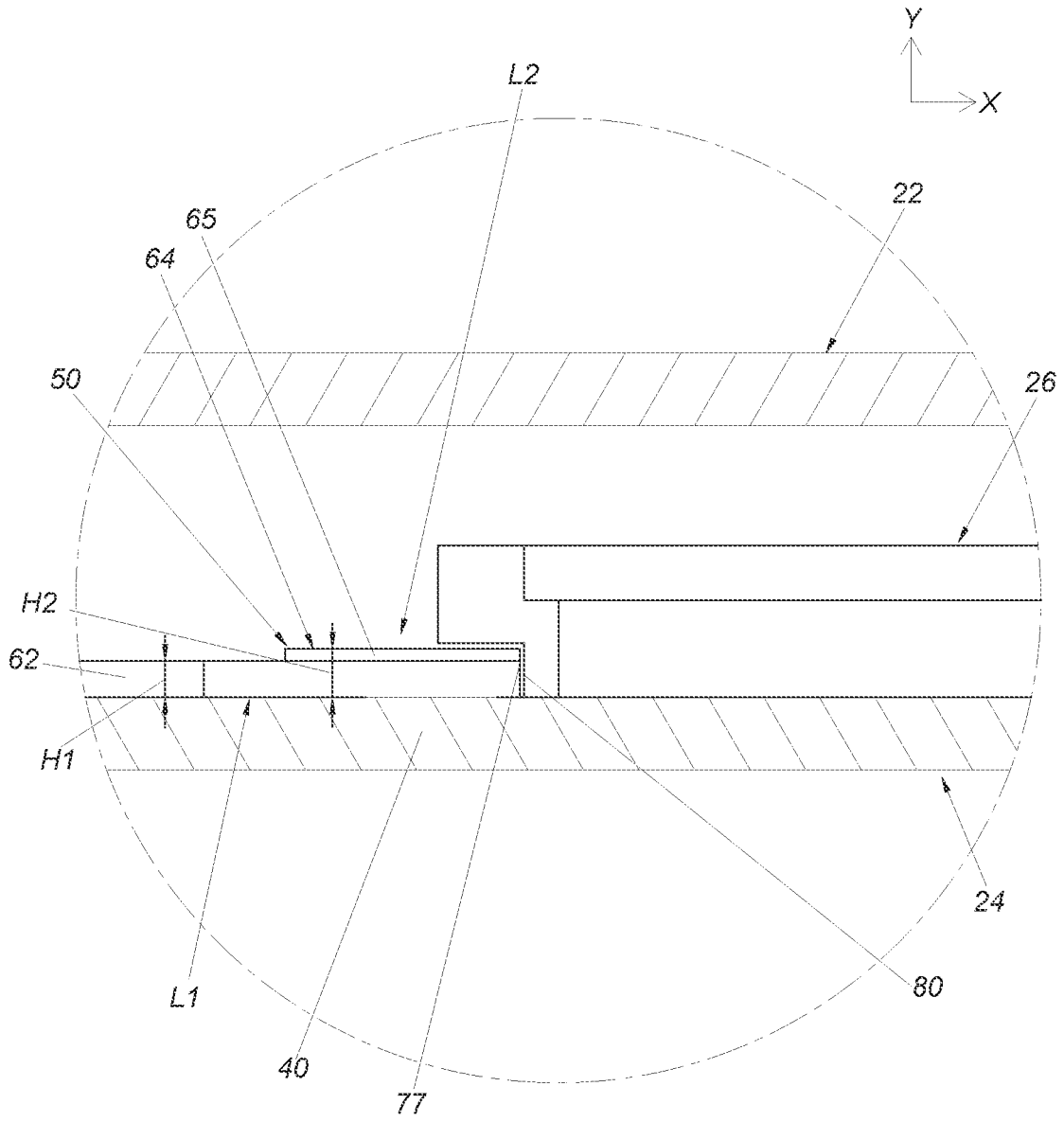
FIG. 8*a* is another schematic view showing the structures between the first rail and the second rail of the slide rail assembly according to the embodiment of the present invention, in particular one of the two components and a driving portion of the corresponding operation member.

As shown in FIG. 6, FIG. 7, and FIG. 8, the first operation member 28 has two opposite sides defined respectively as a first side L1 and a second side L2. The first section 62 of the first driving portion 50 of the first operation member 28 has a first transverse height H1 with respect to the longitudinal wall 40 of the second rail 24, and the second section 64 has a second transverse height H2 with respect to the longitudinal wall 40 of the second rail 24, wherein the second transverse height H2 is greater than the first transverse height H1 (see FIG. 7 and FIG. 8). When the first operation member 28 is operated to work with the first component 26, the second section 64 of the first driving portion 50, or more particularly the second transverse height H2 of the second section 64, helps increase the depth d of contact (e.g., the transverse depth of contact) between the first driving portion 50 and a first corresponding portion 80 of the first component 26. Preferably, the second section 64 contacts the first corresponding portion 80 of the first component 26 through a first guiding feature 77, and the first guiding feature 77 is, for example but not limited to, an inclined surface or a curved surface. Moreover, with the first side L1 of the first section 62 of the first driving portion 50 supporting and supported by the surface of the longitudinal wall 40 of the second rail 24 (i.e., with the two surfaces supporting each other), and with the first section 62 connected to (or being adjacent to) the second section 64, the reliability with which the second section 64 is kept at the second transverse height H2 is enhanced. In other words, the foregoing configuration helps maintain the depth d of contact between the second section 64 and the first corresponding portion 80 of the first component 26, thereby ensuring that the second section 64 of the first operation member 28 and the first corresponding portion 80 of the first component 26 can work with each other (see FIG. 8). It is thus ensured that when the first driving portion 50 of the first operation member 28 and the first corresponding portion 80 of the first component 26 are engaged to work with each other, the contact between them will not be reduced, and that the reliability of the interaction between the first operation member 28 and the first component 26 is therefore increased. Referring to FIG. 8*a*, in addition to having the first side L1 of the first section 62 of the first driving portion 50 support and be supported by the surface of the longitudinal wall 40 of the second rail 24 (i.e., having the two surfaces support each other), the first side L1 of the second section 64 of the first driving portion 50 may be configured to support and be supported by the surface of the longitudinal wall 40 of the second rail 24 (i.e., to make these two surfaces support each other) as well, with a pad 65 joined to the second section 64 by soldering or by locking with a screw/rivet so that the second section 64 has the second transverse height H2. This alternative configuration provides even better support between the first driving portion 50 and the longitudinal wall 40 of the second rail 24.

Figure 9:
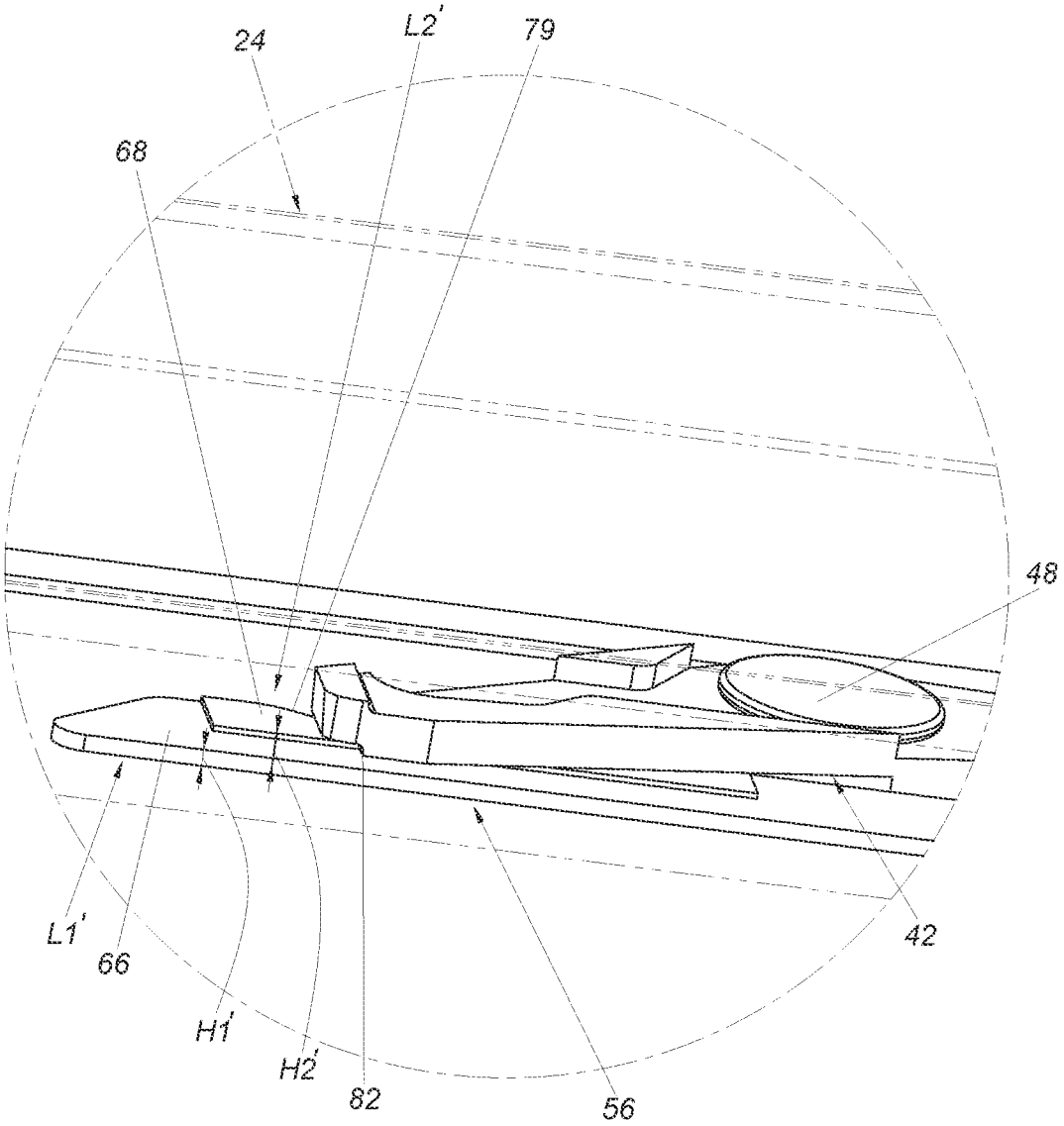
FIG. 9 is an enlarged view of the circled area IX in FIG. 6.

Similarly, referring to FIG. 6 and FIG. 9, the second operation member 44 has two opposite sides defined respectively as a first side L1' and a second side L2'. The first predetermined section 66 of the second driving portion 56 of the second operation member 44 has a first transverse height H1' with respect to the longitudinal wall 40 of the second rail 24, and the second predetermined section 68 has a second transverse height H2' with respect to the longitudinal wall 40 of the second rail 24, wherein the second transverse height H2' is greater than the first transverse height H1' (see FIG. 9). When the second operation member 44 is operated to work with the second component 42, the second predetermined section 68 of the second driving portion 56, or more particularly the second transverse height H2' of the second predetermined section 68, helps increase the depth of contact (e.g., the transverse depth of contact) between the second driving portion 56 and a second corresponding portion 82 of the second component 42. Preferably, the second predetermined section 68 contacts the second corresponding portion 82 of the second component 42 through a second guiding feature 79, and the second guiding feature 79 is, for example but not limited to, an inclined surface or a curved surface. Moreover, with the first side L1' of the first predetermined section 66 of the second driving portion 56 supporting and supported by the surface of the longitudinal wall 40 of the second rail 24 (i.e., with the two surfaces supporting each other), and with the first predetermined section 66 connected to (or being adjacent to) the second predetermined section 68, the reliability with which the second predetermined section 68 is kept at the second transverse height H2' is enhanced. In other words, the foregoing configuration helps maintain the depth of contact between the second predetermined section 68 and the second corresponding portion 82 of the second component 42, thereby ensuring that the second predetermined section 68 of the second operation member 44 and the second corresponding portion 82 of the second component 42 can work with each other (see FIG. 9). It is thus ensured that when the second driving portion 56 of the second operation member 44 and the second corresponding portion 82 of the second component 42 are engaged to work with each other, the contact between them will not be reduced, and that the reliability of the interaction between the second operation member 44 and the second component 42 is therefore increased.

Figure 10:
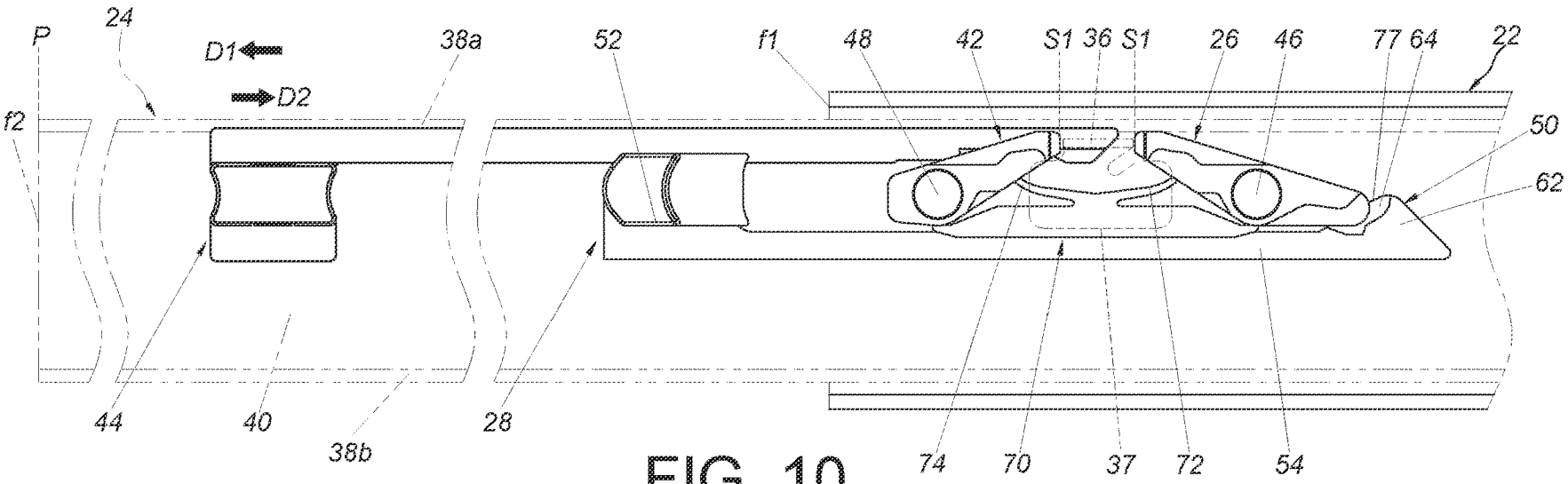
FIG. 10 is a schematic view showing that the second rail and the first rail of the slide rail assembly according to the embodiment of the present invention are kept at a certain position with respect to each other by means of the two components being in a first state.

Referring to FIG. 10, both the first component 26 and the second component 42 can be in a first state S1. More specifically, the first elastic portion 72 of the elastic member 70 applies an elastic force to the first component 26 to keep the first component 26 in the first state S1, and the first component 26 abuts against the first wall 38*a* of the second rail 24 when in the first state S1 Similarly, the second elastic portion 74 of the elastic member 70 applies an elastic force to the second component 42 to keep the second component 42 in the first state S1, and the second component 42 abuts against the first wall 38*a* of the second rail 24 when in the first state S1.

When the second rail 24 is at an extended position P with respect to the first rail 22, the front end f2 of the second rail 24 extends a certain distance beyond the front end f1 of the first rail 22. With the first component 26 and the second component 42 both in the first state S1 and respectively adjacent to two ends (e.g., the rear end and the front end) of the blocking portion 36, the second rail 24 is kept from moving away from the extended position P in a second direction D2 as well as in a first direction D1, wherein the first direction D1 and the second direction D2 are opposite directions.

Figure 11:
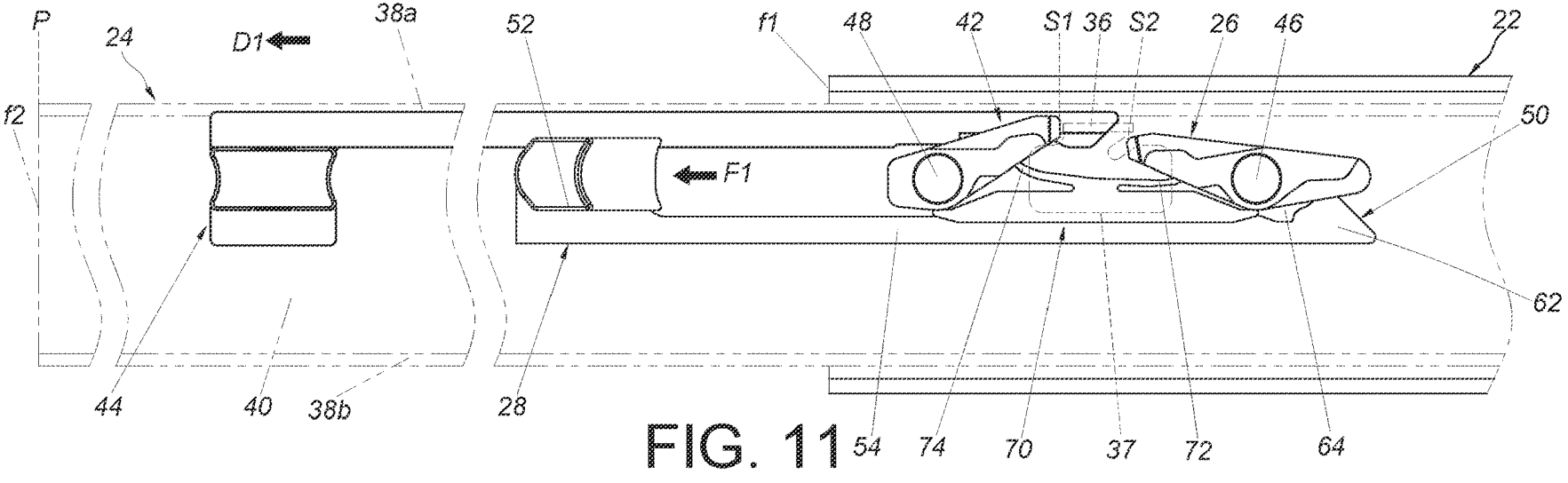
FIG. 11 is a schematic view showing that the second rail of the slide rail assembly according to the embodiment of the present invention is displaceable in a first direction as one of the two components is in a second state.

Referring to FIG. 10 and FIG. 11, when the first operation member 28 is operated (e.g., when a user applies a first force F1 to the first operating portion 52 of the first operation member 28), the first operation member 28 is displaced. Once the first guiding feature 77 of the second section 64 of the first driving portion 50 is brought into contact with the first corresponding portion 80 of the first component 26 (see FIG. 7 and FIG. 8), the first operation member 28 can be used to drive the first component 26 into motion (e.g., pivotal movement) and thereby bring the first component 26 from the first state S1 (see FIG. 10) into a second state S2 (see FIG. 11). The first component 26 in the second state S2 does not abut against the first wall 38*a* of the second rail 24, so the second rail 24 is allowed to be displaced from the extended position P in the first direction D1 in order to be detached from the channel of the first rail 22. It is worth mentioning that the first elastic portion 72 of the elastic member 70 is accumulating a first elastic force when the first component 26 is in the second state S2. Once the user stops applying the first force F1, the first component 26 returns from the second state S2 to the first state S1 in response to the first elastic portion 72 releasing the first elastic force.

Figure 12:
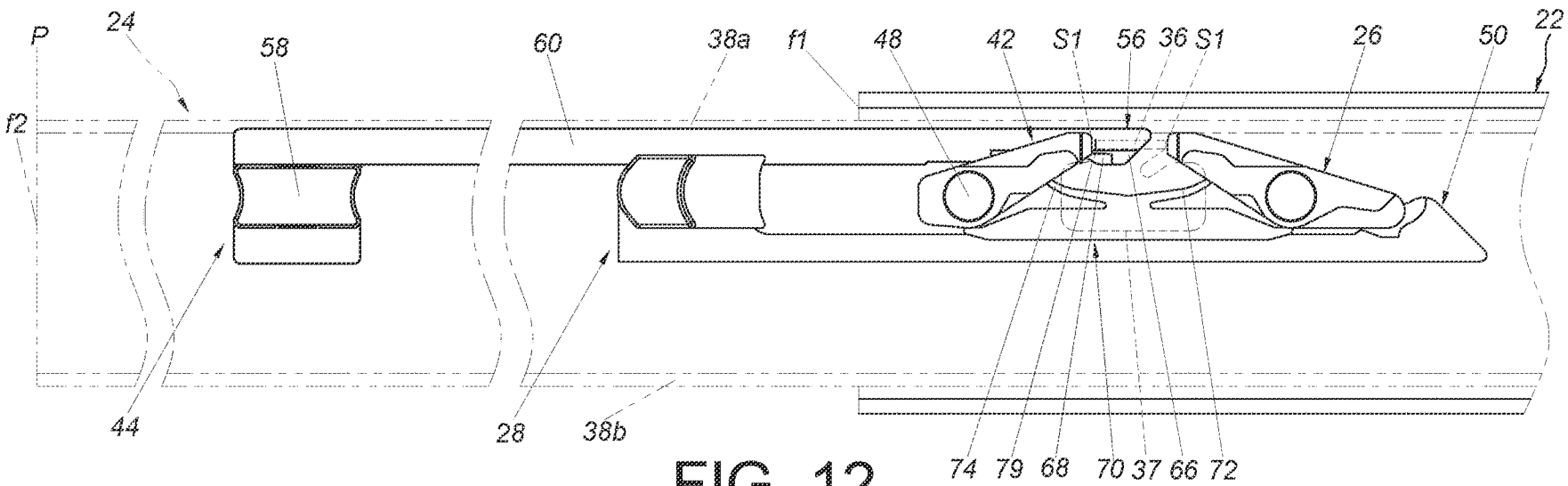
FIG. 12 is a schematic view showing that the second rail and the first rail of the slide rail assembly according to the embodiment of the present invention are kept at a certain position with respect to each other by means of the two components being in the first state.
Figure 13:
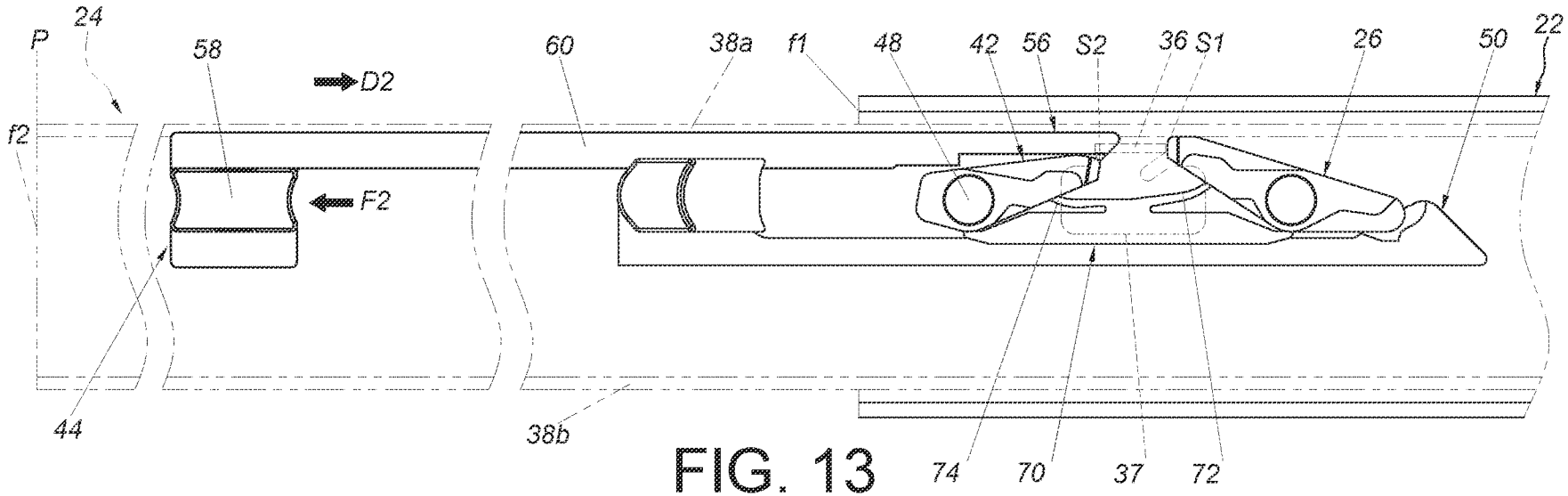
FIG. 13 is a schematic view showing the second rail of the slide rail assembly according to the embodiment of the present invention is displaceable in a second direction as a different one of the two components is in the second state.

Referring to FIG. 12 and FIG. 13, when the second operation member 44 is operated (e.g., when the user applies a second force F2 to the second operating portion 58 of the second operation member 44), the second operation member 44 is displaced. Once the second guiding feature 79 of the second predetermined section 68 of the second driving portion 56 is brought into contact with the second corresponding portion 82 of the second component 42 (see FIG. 9), the second operation member 44 can be used to drive the second component 42 into motion (e.g., pivotal movement) and thereby bring the second component 42 from the first state S1 (see FIG. 12) into the second state S2 (see FIG. 13). The second component 42 in the second state S2 does not abut against the first wall 38*a* of the second rail 24, so the second rail 24 is allowed to be displaced from the extended position P to a retracted position in the second direction D2. It is worth mentioning that the second elastic portion 74 of the elastic member 70 is accumulating a second elastic force when the second component 42 is in the second state S2. Once the user stops applying the second force F2, the second component 42 returns from the second state S2 to the first state S1 in response to the second elastic portion 74 releasing the second elastic force.

According to the above, the foregoing embodiment is characterized in that the contact between the first driving portion 50 of the first operation member 28 and the first corresponding portion 80 of the first component 26 will not be compromised by an external force or unexpected factor, and that the reliability of the interaction between the first operation member 28 and the first component 26 is therefore enhanced. The same technical principle and its technical effects apply to the second driving portion 56 (including the first predetermined section 66 and the second predetermined section 68) of the second operation member 44 and the second corresponding portion 82 of the second component 42.

While the present invention has been disclosed through the preferred embodiment described above, it should be understood that the embodiment is not intended to be restrictive of the scope of the invention. The scope of the patent protection sought by the applicant is defined by the appended claims.

What is claimed is:

1. A slide rail assembly, comprising:

a first rail;

a second rail longitudinally displaceable with respect to the first rail, wherein the second rail includes a first wall, a second wall, and a longitudinal wall connected between the first wall and the second wall of the second rail;

a first component movably disposed on the second rail;

a first operation member movably disposed on the second rail, wherein the first operation member is configured to be operated in order to drive the first component, the first operation member includes a first driving portion, and the first driving portion has a first section and a second section connected to the first section;

wherein the first section of the first driving portion has a first transverse height with respect to the longitudinal wall of the second rail, the second section has a second transverse height with respect to the longitudinal wall of the second rail, and the second transverse height is greater than the first transverse height;

wherein the first section of the first driving portion and the longitudinal wall of the second rail support each other to maintain the second section of the first driving portion at the second transverse height, wherein when the first operation member is operated, the second section of the first driving portion is brought into contact with a first corresponding portion of the first component in order for the first operation member to drive the first component; and, a second component and a second operation member, both movably disposed on the second rail, wherein the second operation member is configured to be operated in order to drive the second component, the second operation member includes a second driving portion, the second driving portion has a first predetermined section and a second predetermined section connected to the first predetermined section, the first predetermined section of the second driving portion has another first transverse height with respect to the longitudinal wall of the second rail, the second predetermined section has another second transverse height with respect to the longitudinal wall of the second rail, the another second transverse height is greater than the another first transverse height, the first predetermined section of the second driving portion and the longitudinal wall of the second rail support each other to maintain the second predetermined section of the second driving portion at the another second transverse height, and when the second operation member is operated, the second predetermined section of the second driving portion is brought into contact with a second corresponding portion of the second component in order for the second operation member to drive the second component.

2. The slide rail assembly of claim 1, wherein the first rail includes a blocking portion, both the first component and the second component are able to be in one of a first state and a second state, and when the second rail is at an extended position with respect to the first rail and both the first component and the second component are in the first state, the first component and the second component are respectively adjacent to two ends of the blocking portion to prevent the second rail from moving away from the extended position.

3. The slide rail assembly of claim 2, further comprising an elastic member disposed on the second rail, wherein the elastic member is configured to apply an elastic force to the first component and the second component and thereby keep the first component and the second component in the first state.

4. The slide rail assembly of claim 3, wherein the first component is configured to be moved and thereby brought from the first state into the second state when the first operation member is operated, thus allowing the second rail to be displaced from the extended position in a first direction, and the second component is configured to be moved and thereby brought from the first state into the second state when the second operation member is operated, thus allowing the second rail to be displaced from the extended position in a second direction, which is the opposite direction of the first direction.

5. The slide rail assembly of claim 2, wherein the blocking portion is adjacent to a front end of the first rail.

6. The slide rail assembly of claim 1, further comprising a third rail, wherein the first rail is movably mounted between the third rail and the second rail.

7. The slide rail assembly of claim 1, wherein the first component and the second component are pivotally connected to the second rail via a first shaft and a second shaft respectively.

8. A slide rail assembly, comprising:

a first rail;

a second rail longitudinally displaceable with respect to the first rail, wherein the second rail includes a first wall, a second wall, and a longitudinal wall connected between the first wall and the second wall of the second rail;

a first component movably disposed on the second rail;

a first operation member configured to be operated in order to drive the first component, wherein the first operation member includes a first driving portion, and the first driving portion has a first section and a second section connected to the first section;

wherein the first section of the first driving portion has a first transverse height with respect to the longitudinal wall of the second rail, the second section has a second transverse height with respect to the longitudinal wall of the second rail, and the second transverse height is greater than the first transverse height; wherein when the first operation member is operated, a first guiding feature of the second section of the first driving portion is brought into contact with a first corresponding portion of the first component in order for the first operation member to drive the first component; and, a second component and a second operation member, both movably disposed on the second rail, wherein the second operation member is configured to be operated in order to drive the second component; the second operation member includes a second driving portion; the second driving portion has a first predetermined section and a second predetermined section connected to the first predetermined section; the first predetermined section of the second driving portion has another first transverse height with respect to the longitudinal wall of the second rail, the second predetermined section has another second transverse height with respect to the longitudinal wall of the second rail, and the another second transverse height is greater than the another first transverse height; when the second operation member is operated, a second guiding feature of the second predetermined section of the second driving portion is brought into contact with a second corresponding portion of the second component in order for the second operation member to drive the second component.

9. The slide rail assembly of claim 8, wherein the first rail includes a blocking portion, both the first component and the second component are able to be in one of a first state and a second state, and when the second rail is at an extended position with respect to the first rail and both the first component and the second component are in the first state, the first component and the second component are respectively adjacent to two ends of the blocking portion to prevent the second rail from moving away from the extended position.

10. The slide rail assembly of claim 9, further comprising an elastic member disposed on the second rail, wherein the elastic member is configured to apply an elastic force to the first component and the second component and thereby keep the first component and the second component in the first state.

11. The slide rail assembly of claim 10, wherein the first component is configured to be moved and thereby brought from the first state into the second state when the first operation member is operated, thus allowing the second rail to be displaced from the extended position in a first direction.

12. The slide rail assembly of claim 11, wherein the second component is configured to be moved and thereby brought from the first state into the second state when the second operation member is operated, thus allowing the second rail to be displaced from the extended position in a second direction, which is the opposite direction of the first direction.

13. The slide rail assembly of claim 9, wherein the blocking portion is adjacent to a front end of the first rail.

14. The slide rail assembly of claim 8, further comprising a third rail, wherein the first rail is movably mounted between the third rail and the second rail.

15. The slide rail assembly of claim 8, wherein the first component and the second component are pivotally connected to the second rail via a first shaft and a second shaft respectively.

* * * * *